US005457470A

United States Patent [19]

Hai et al.

[11] Patent Number: 5,457,470

[45] Date of Patent: Oct. 10, 1995

[54] M-TYPE ANTENNA FOR VEHICLES

[75] Inventors: Xu Hai; Yoshimi Egashira, both of Kanagawa, Japan

[73] Assignee: Harada Kogyo Kabushiki Kaisha, Tokyo, Japan

[21] Appl. No.: 99,624

[22] Filed: Jul. 30, 1993

[51] Int. Cl.[6] ..... H01Q 9/30

[52] U.S. Cl. ..... 343/828; 343/830; 343/713

[58] Field of Search ..... 343/700 MS, 713, 343/828, 829, 830, 834; H01Q 1/32, 9/30

[56] References Cited

U.S. PATENT DOCUMENTS

| | | | |
|---|---|---|---|
| 4,611,214 | 9/1986 | Campbell et al. | 343/834 |
| 4,931,806 | 6/1990 | Wunderlich | 343/713 |
| 5,291,210 | 3/1994 | Nakase | 343/713 |

FOREIGN PATENT DOCUMENTS

| | | | |
|---|---|---|---|
| 0688040 | 2/1953 | United Kingdom | 343/825 |

*Primary Examiner*—Donald Hajec
*Assistant Examiner*—Tan Ho
*Attorney, Agent, or Firm*—Koda and Androlia

[57] ABSTRACT

An M-type car antenna for traffic information communication systems including an antenna element having a length which is one-half of the wavelength of the radio way used in the information communication systems, and a connector which is connected via an electrostatic coupling to the center-of the antenna element, the impedance matching and feeding being carried out by the connector. In this antenna, the voltage polarity of the connector at the coupling point and that of the center of the antenna element are set to be opposite from each other, and the electric current in the antenna element and that in the connector are set to be in the same direction. Thus, the M-type antenna is compact and easy to manufacture with stable antenna characteristics.

2 Claims, 4 Drawing Sheets

M-TYPE ANTENNA FOR VEHICLES

BACKGROUND OF THE INVENTION

1. Field of the Invention

The present invention relates to an M-type antenna for vehicles used in traffic information communication systems, and more particularly, to an improvement in the power supply means of such an antenna.

2. Prior Art

One of the traffic information communication systems currently used is a so-called on-road wireless communication information system.

In this communication system, on-road stations are established at certain intervals along the road, and a limited-radius wireless communication zone is created by each one of the on-road stations. From these stations, non-variable information regarding the driver's current location, the road configuration, etc., as well as variable information regarding traffic conditions moving forward and road construction, etc., are communicated in a short period of time to each car passing through the limited-radius wireless communication zone.

Since this system provides information intermittently in the limited-radius wireless communication zones, it is not possible to provide continuous and detailed information as seen in the general wireless communication systems. However, the advantage of the wireless communication system is a secure and stable propagation path and a lack of interference with the radio waves. Thus, various kinds of information is supplied to the passing cars very quickly and accurately.

Incidentally, with regard to the on-road stations, there are two different kinds: independent on-road stations and on-line on-road stations. Though the independent on-road stations continuously provide non-variable information only, the on-line on-road stations can provide variable information sent from an information center through a wired or wireless circuit simultaneously with the non-variable information.

FIG. 4 shows an electrical diagram of a conventional M-type car antenna used in a traffic information communication system as described above.

As shown in this Figure, an antenna element 40 of the M-type car antenna has a pair of emission sections 41 and 42 with one end of each one of the sections being grounded. The emission sections 41 and 42 are vertical segments of a conductive material formed in an inverted U shape. The emission sections 41 and 42 are connected to each other in series via transmission sections 43 and 44. Another emission section 45, which works also as a power supply member, is connected to a connection point between the transmission sections 43 and 44.

The total length of the conductive material of the antenna element 40, such a length being from one emission section 41 to the other emission section 42 through the transmission sections 43 and 44, is set to be equal to the wavelength λ of the radio wave used in the information communication system. In this antenna element 40, in order to ensure an effective emission, the direction of the electric current i1 and i2 in the emission sections 41 and 42, respectively, is aligned with the direction of the electric current i5 of the emission section 45, which works also as a power supply member.

As generally known, in an M-type antenna, unless the maximum electric current is provided in the same direction to the three vertical sections, i.e., the emission sections 41, 42 and 45 of the antenna element 40, the emission and reception of the radio waves does not take place.

FIG. 4(*b*) shows the characteristic of current distribution i and the characteristic of voltage distribution V of the antenna element 40 as described above. FIG. 4(*c*) shows the impedance characteristic Zi of the antenna element 40. The horizontal axes in FIGS. 4(*b*) and 4(*c*) represent the conductive paths of the antenna element 40, one path for the connecting points a1, b1, c1 and e, and the other for connecting the points e, c2, b2 and a2, which are presented as straight lines in the drawing for the sake of convenience.

The points a1 and a2 are both grounded and electrically short-circuited. Therefore, the electric current level at these points is at a maximum. Because the length between the points a1 and a2 is λ, a maximum electric current point is also created at point C, which is the center point between the points a1 and a2. Voltage has a right-angle phase differential relative to electric current. Therefore, at points a1, C and a2, where the electric current level is at the maximum, the voltage level is zero. At points b1 and b2, where the electric current level is zero, the voltage is at the maximum.

Impedance is zero at points a1, C and a2, where the electric current level is at the maximum and the voltage level is zero. At points b1 and b2, where the electric current level is zero and the voltage level is at the maximum, impedance is at the maximum (infinite). Accordingly, the power supply should take place at the point where the impedance is 50 ohms, which is on the path where the impedance changes from zero to maximum (infinite). This power supply point e is, as seen from the above explanation, slightly to the right or left of the center point C between the points a1 and a2.

In order to obtain effective emission using the conventional M-type antenna, the direction of the electric current i1 and i2 in the emission sections 41 and 42 at both sides must be the same as that of the electric current i5 of the emission section 45, which works also as a power supply member. Accordingly, it is necessary to set the length of the conductive path connecting points a1, b1, c1 and e, as well as that of the connecting points e, c2, b2 and a2, at λ/2. As a result, the entire length of the conductive path connecting points a1, b1, cl, c2, b2 and a2 would range between λ/2 and λ. Thus, the conventional M-type antenna has a drawback in that it is quite large in size.

On the other hand, impedance rapidly changes from zero to infinite when proceeding from point C to b1 or b2. Because of this, it is very difficult to find a point where the impedance is exactly 50 ohms between the points C and b1 and between the points C and b2. Therefore, the conventional M-type antenna has problems in that the required precision is not easily obtained in mass production and that there are large variations in the antenna characteristics.

SUMMARY OF THE INVENTION

The present invention is made in view of the problems of the prior art antennas, and the object is to provide an M-type antenna for vehicles or an M-type car antenna which is compact and easy to manufacture and has constant and stable characteristics.

In order to accomplish the object, the present invention uses a unique structure comprising:

a. a length setting means which sets the length of a conductive material that makes an M-type antenna element to be ½ of the wavelength λ (lambda) of the radio wave used in a traffic information communication system, such a length being from one emission section to the other emission section with a transmission section in between;

b. a central emission section which includes a connector electrostatically coupled to the center of the transmission section of the conductive material whose length is set to be λ/2 by the length setting means, the central emission section performing impedance matching and power supply (feeding) via the connector; and c. a setting means which sets the voltage polarity at the connecting point of the connector that is electrostatically coupled and the voltage polarity at the center of the transmission section to be opposite, the setting means further setting the direction of the current running in the two emission sections to be the same as the current running in the central emission section.

With the structure as described above, the antenna of the present invention has the following advantages:

a. The entire length of the conductive material of the M-type antenna element, such a length extending from one emission section to the other emission section via the transmission section that is between the two emission sections, is set to be one-half of the wavelength of the radio wave used. In addition, the impedance matching and power supply (or feeding) takes place via a connector that is connected via an electrostatic coupling to the center of the transmission section, so that necessary functions occur. Accordingly, the entire length of the antenna element can be approximately one-half of the conventional one, making the antenna quite small.

b. The impedance matching and the power supply (feeding) occur through the connector which is connected to the center of the transmission section of the antenna element via an electrostatic coupling. Accordingly, a horizontal plane emission pattern which is most effective relative to a front-back direction of the vehicle and which allows sufficient balance relative to a left-right direction of the vehicle can be obtained. Thus, the antenna of the present invention can function well as an M-type vehicle antenna for traffic information communication systems.

c. At the electrostatic coupling point in the antenna of the present invention, the impedance conversion occurs quickly vis-a-vis the grounded point. As a result, if the gap between the center of the transmission section and the connector is set in advance to be 50 ohms, an impedance which is approximately 50 ohms can be obtained at the connection point. Therefore, even if there are slight variations in where the power supply cable is connected to the connector, there will be almost no effect over the impedance characteristic, and a stable impedance characteristic can be obtained. In other words, the impedance at the point of connection of the power supply cable can be stable. Furthermore, even if the center of the connector is not exactly at the center of the transmission section, there will be only a slight influence over the characteristics. Therefore, no particular precision is required in the patterning process for the emission and transmission sections, etc., which allows for extremely easy manufacturing and provides the antenna with constant and stable characteristics.

DETAILED DESCRIPTION OF THE INVENTION

FIG. 1(*a*) shows an on-road wireless communication information system, FIG. 1(*b*) is a perspective view of an M-type antenna mounted on a car, FIG. 1(*c*) shows the plane emission pattern of the M-type car antenna according to the present invention; and FIG. 1(*d*) shows a horizontal plane emission pattern thereof.

As shown in FIG. 1(*a*), in this on-road wireless communication information system, so-called on-road stations 11*a*, 11*b*, and so on are established at certain intervals, and limited-radius wireless communication zones 12*a*, 12*b*, and so on are created by each of these on-road stations 11*a*, 11*b*, . . .

Invariable information such as the driver's current location, road configuration, etc. as well as variable information regarding such things as traffic conditions moving in the forward direction and road construction, etc., are communicated and supplied in a short period of time to cars 13*a*, 13*b*, etc. that are passing through the limited-radius areas 12*a*, 12*b*, etc.

As shown in FIG. 1(*b*), an antenna element 20 of the M-type car antenna is mounted on the front dashboard, for example, of a car 13. The directivity of the antenna element 20 is set so that its vertical plane emission pattern PA is that as shown in FIG. 1(*c*), and its horizontal plane emission pattern PB is that as shown in FIG. 1(*d*).

Figure 1A:
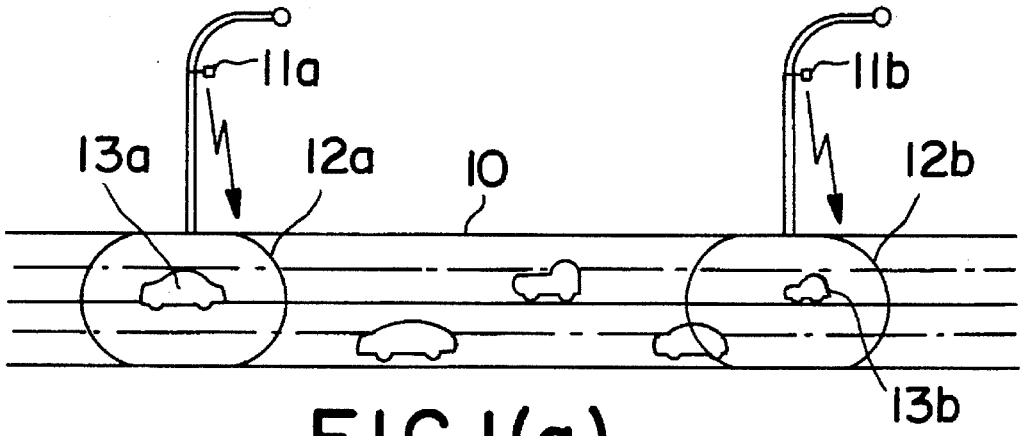
FIGS. 1(*a*) through 1(*d*) show the overview of an M-type car antenna according to the present invention.
Figure 1B:
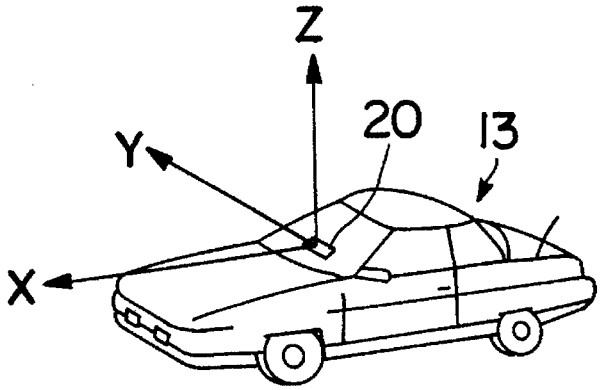
Figure 1C:
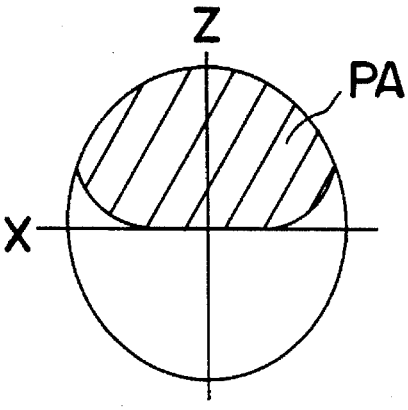
Figure 1D:
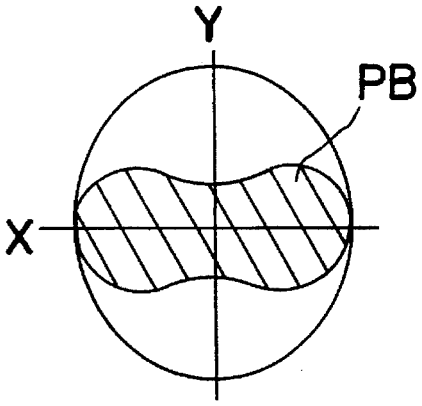
Figure 2A:
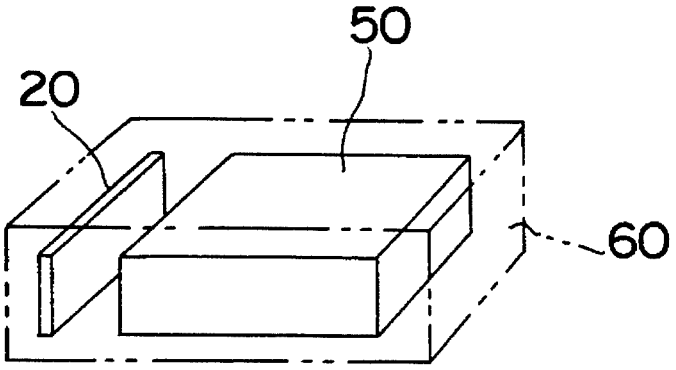
FIGS. 2(*a*) and 2(*b*) show the mechanical construction thereof.
Figure 2B:
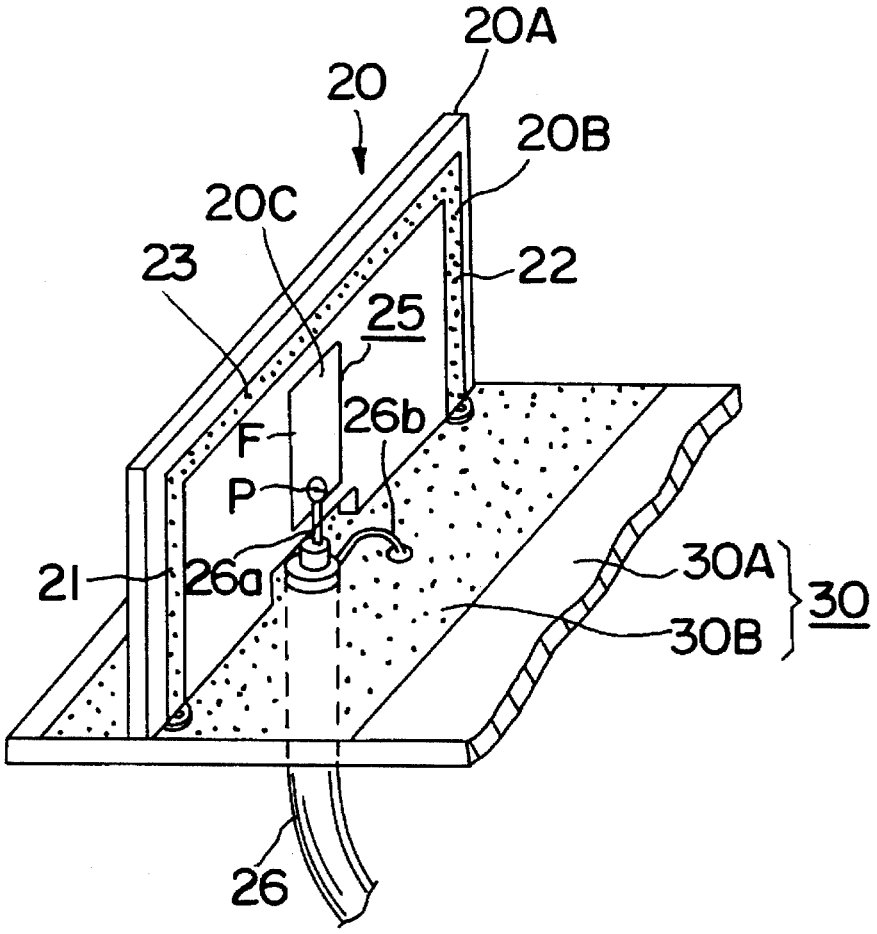

FIGS. 2(*a*) and 2(*b*) show the structure of the M-type car antenna of the present invention, and FIG. 2(*a*) shows the outer appearance thereof, and FIG. 2(*b*) shows a specific internal structure thereof.

As shown in FIG. 2(*a*), the antenna element 20, called VICS and used in the on-road communication information system, is integrated in a casing 60 along with an antenna element 50 of another information receiving antenna called GPS.

As seen from FIG. 2(*b*), the antenna element 20 comprises copper foil areas 20B and 20C which are formed on a surface of a printed circuit board 20A via etching. The copper foil areas 20B constitutes a conductive material in an inverted U shape and includes a pair of emission sections 21 and 22 at both ends and a transmission section 23 at the top and between the two emission sections 21 and 22. The copper foil area 20C constitutes a connector (or connecting member) F of an emission section 25, which effects impedance matching and power supply (feeding).

The printed circuit board 20A, which is a flat plate, is provided vertically on a ground circuit board 30. The ground circuit board 30 is obtained by forming a grounding copper foil area 30B on the surface of an insulation board 30A. A through hole into which a power supply cable is inserted is formed in the vicinity of the center of the ground circuit board 30.

A tip end of a coaxial power supply cable 26 is led from the back to the top of the grounding circuit board 30 passing the through hole. The central conductor 26a at the tip end of the power supply cable 26 is connected to a cable connection point P of the connector F of the emission section 25. The outer conductor 26b which is at the tip end of the power supply 26 is similarly led to the top side of the grounding circuit board 30 and connected to the grounding copper foil area 30B.

Both ends of the conductive material in the inverted U shape, that is, the lower end of each one of the emission sections 21 and 22, respectively, are connected to the grounding copper foil area 30B.

Figure 3A:
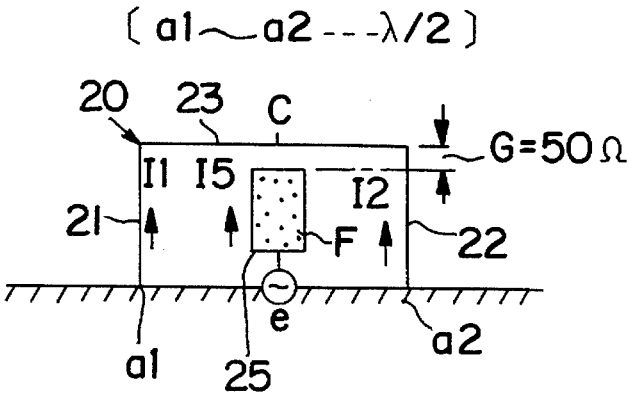
FIGS. 3(*a*) through 3(*c*) show the electrical construction thereof.
Figure 3B:
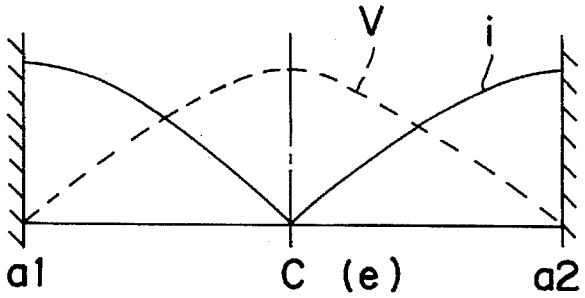
Figure 3C:
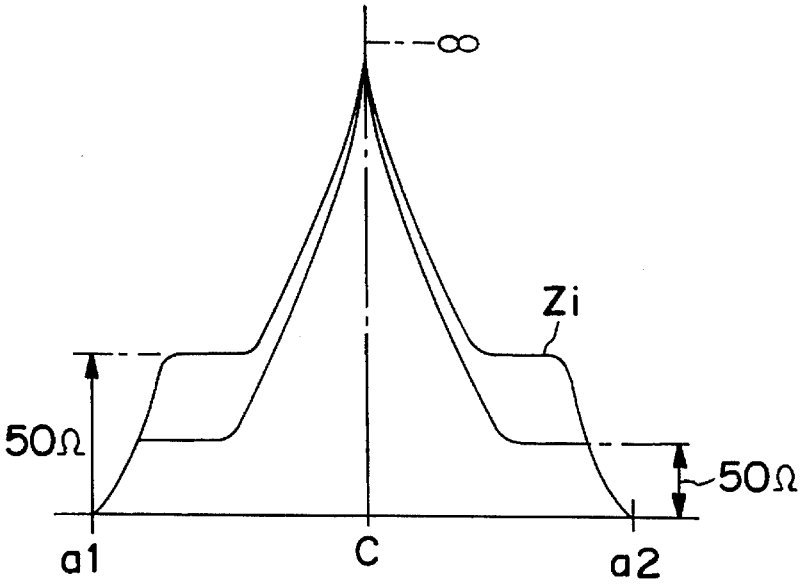
Figure 4A:
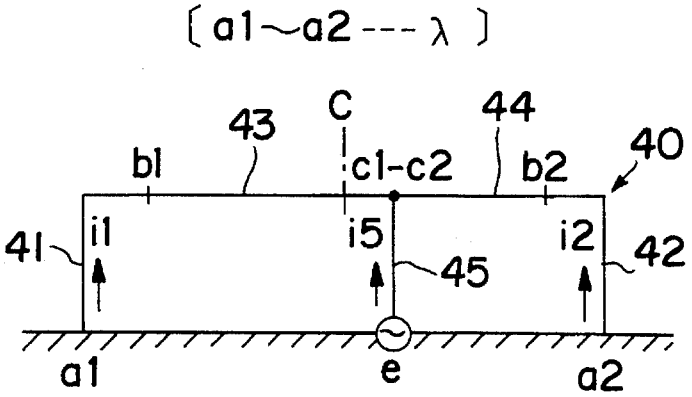
FIG.4(a) PRIOR ART
FIGS. 4(*a*) through 4(*c*) show the electrical construction of a conventional M-type vehicle antenna.
Figure 4B:
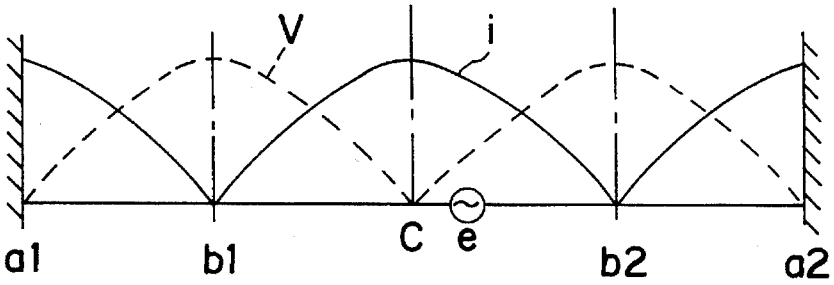
FIG.4(b) PRIOR ART
Figure 4C:
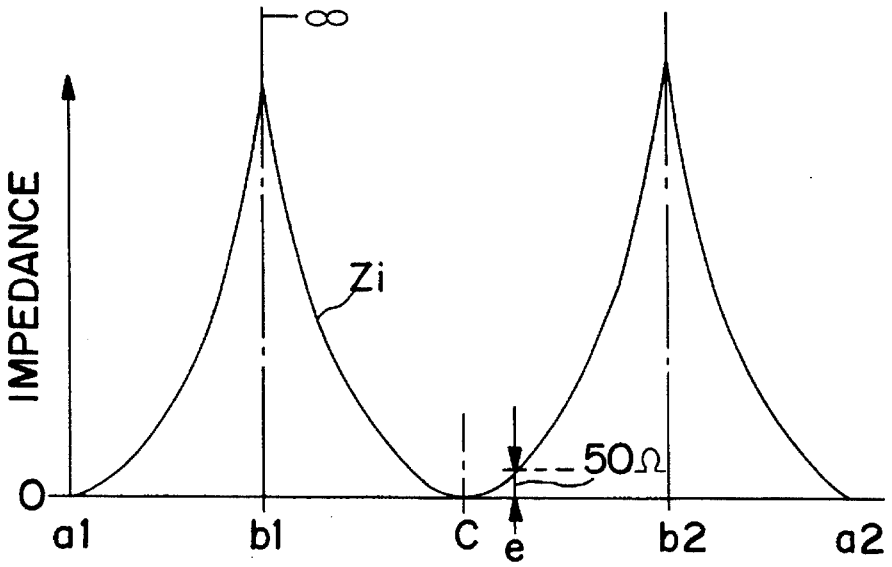
FIG.4(c) PRIOR ART

FIGS. 3(*a*) through 3(*c*) show electrical connections of the M-type car antenna as structured in FIG. 2(*b*).

As shown in FIG. 3(*a*), the antenna element 20 has the pair of emission sections 21 and 22, and one end of each of which is grounded at a1 and a2. As described above, the emission sections 21 and 22 are two vertical segments of the conductive material formed in an inverted U shape, and the transmission section 23 is a horizontal segment that connects these two emission sections 21 and 22. The length of the conductive material of the antenna element 20 is set to be $\lambda/2$, in which the wavelength of the radio wave used for the antenna is $\lambda$. In other words, the length that is from the end of the emission section 21 to the end of the other emission section 22 plus the length of the transmission section 23 is set to be half the wavelength of the radio wave used for traffic information systems.

The antenna as described above is further designed so that the impedance matching and the power supply (feeding) are carried out by the connector F that is connected via an electrostatic coupling to the center of the transmission section 23 of the conductive material whose length is set to be $\lambda/2$ as described above. In other words, the connector F is electrostatically coupled to a point C.

The voltage polarity of the connector (or connecting member) F at the electrostatic coupling connection point and that of the center of the transmission section 23 are set to be opposite from each other. In addition, the electric current I1, I2 and I5 that flow in the emission sections 21 and 22 is set to be in the same direction as the electric current in the emission section 25 which is installed between the two emission sections 21 and 22.

FIG. 3(*b*) shows the characteristic of current distribution i and the characteristic of voltage distribution V of the antenna element 20. FIG. 3(*c*) shows the impedance characteristic Zi of the antenna element 20. The lateral axis in each of FIGS. 3(*b*) and 3(*c*) represents the conductive path of the antenna element 20. In other words, the conductive path is divided into two in these Figures, and one path is a line obtained by connecting the points a1, C and e, and the other path is a line obtained by connecting the points e, C and a2, which are presented as straight lines for the sake of convenience.

Points a1 and a2 are the grounded end of the emission sections 21 and 22 and are electrically short-circuited. Therefore, the electric current level at these points becomes the maximum. Because the length between a1 and a2 is $\lambda/2$ as described above, the point of maximum electric current is not formed at point C, which is the center between the points a1 and a2. Voltage has a right-angle phase differential relative to the electric current. Therefore, at points a1 and a2, where the electric current level is at the maximum, the voltage level is zero. At point C, where the electric current level is zero, the voltage is at the maximum.

Impedance is zero at points a1 and a2, where the electric current level is at the maximum and the voltage level is zero. At point C, where the electric current level is zero and the voltage level is at the maximum, the impedance is at the maximum (infinite).

As seen from the above:

(1) In the antenna of the present invention, the entire length, that is from one emission section 21 to the other emission section 22 and the transmission section 23, of the conductive material of the antenna element 20 is set to be one-half of the wavelength of the radio wave used. In addition, the impedance matching and power supply (feeding) take place via the connector F which is connected via an electrostatic coupling to the center of the transmission section 23, so that necessary functions occur. Accordingly, the entire length of the antenna element 20 can be as small as approximately one-half of the conventional one, thus making the antenna quite small.

(2) In the antenna of the present invention, the impedance matching and the power supply (feeding) are carried out by the connector F which is connected via an electrostatic coupling to the center of the transmission section 23 of antenna element 20. Therefore, a horizontal plane emission pattern PB as shown in FIG. 1(*d*) is obtained, which is the most effective in view of the front-to-back direction of a car and which allows sufficient balance in view of the left-to-right direction of the car. Thus, the antenna of the present invention works efficiently as an M-type car antenna suitable for traffic information communication systems.

(3) At the electrostatic coupling point, the impedance conversion occurs quickly vis-a-vis the grounded point. As a result, if the gap G between the center of the transmission section and the connector is set in advance at 50 ohms, an impedance that is close to approximately 50 ohms is obtained in the area of connector F. Therefore, even if there are slight differences in where the power supply cable 26 is connected to the connector F, there will be almost no effect on the impedance characteristic, and a stable impedance characteristic is obtained. In other words, the impedance at point P where the power supply cable is connected can be made stable. In addition, even if the center of the connector F is not exactly at the center of the transmission section 23, influence over the antenna characteristics can be minimum. Therefore, no particular precision is required in the patterning process for the emission and transmission sections, etc., which allows for extremely easy manufacturing and provides a product with constant and stable characteristics.

The present invention is not limited to that described above, and naturally it may be embodied in various fashions within the spirit and the principle of the present invention.

As seen from the above, according to the present invention, (1) the length of the conductive material of the M-type antenna element, such a length being from one emission section to the other emission section through a transmission section, is set to be one-half of the wavelength of the radio wave used; (2) the impedance matching and the power supply (feeding) are carried out via a connector that is connected via an electrostatic coupling to the center of the transmission unit of the conductive material; and (3) the voltage polarity of the connector at the electrostatic coupling point and that which is at the center of the transmission section are set to be opposite, and the electric current running in the emission sections is set to be in the same direction as that running in the emission section (or connector). Accordingly, the M-type car antenna can be small and easy to manufacture and also has constant and stable characteristics.

We claim:

1. An M-type car antenna comprising:

an antenna element of $\lambda/2$ on total length in which $\lambda$ is a wavelength of a radio wave used in a traffic information communication system, said total length is one emission sections an other emission section and a transmission section connecting together said one emission section and said other emission section;

a central emission section spaced apart from said antenna element, said central emission section for electrostatic coupling to a center of said transmission section, said central emission section far impedance matching and feeding of said antenna element; and a means for setting a voltage polarity at connection point of said central emission section and a voltage polarity at a center of said transmission section to be opposite from each other and for further setting a direction of electric current in said emission sections to be the same as a direction of electric current in said central emission section.

2. An M-type car antenna comprising:

an antenna element in an inverted U shape and including two vertical emission sections and a horizontal transmission section, a total length of said antenna element being one half of a wavelength of a radio wave used in a traffic information communication system;

a connecting member spaced apart from said antenna element and electrostatically coupled to a center of said horizontal transmission section of said antenna element; and a feeder line connected to said connecting member wherein impedance matching and feeding are accomplished via said connecting member; and wherein a voltage polarity at a point where said connecting member is electrostatically coupled to said horizontal transmission section is opposite to a voltage polarity at a center of said transmission section, and a direction of an electric current in said two vertical emission sections is the same as a direction of an electric current in said connecting member.

* * * * *